United States Patent [19]

Borel et al.

[11] Patent Number: 4,592,396

[45] Date of Patent: Jun. 3, 1986

[54] MULTI-LAYER CLOTHING FOR PAPERMAKING MACHINES

[75] Inventors: Georg Borel, Reutlingen, Fed. Rep. of Germany; Bengt Jonsson, Upsala, Sweden

[73] Assignee: Hermann Wangner-GmbH & Co. KG, Fed. Rep. of Germany

[21] Appl. No.: 638,361

[22] Filed: Aug. 7, 1984

[30] Foreign Application Priority Data

Aug. 17, 1983 [DE] Fed. Rep. of Germany ..... 3329739

[51] Int. Cl.[4] ..... D03D 15/00; D21F 1/10; B01D 39/10

[52] U.S. Cl. ..... 139/425 A; 139/383 A; 139/413; 162/DIG. 1; 428/257

[58] Field of Search ..... 139/383 A, 425 A, 408–413; 162/DIG. 1, 348, 358; 245/8; 428/224, 257

[56] References Cited

U.S. PATENT DOCUMENTS

| | | | |
|---|---|---|---|
| 2,180,054 | 11/1939 | Hindle et al. | 139/408 |
| 3,214,326 | 10/1965 | Lee | 139/383 A |
| 3,885,602 | 5/1975 | Slaughter | 139/425 A |
| 3,885,603 | 5/1975 | Slaughter | 139/425 A |
| 4,501,303 | 2/1985 | Osterberg | 139/425 A |
| 4,554,953 | 11/1985 | Borel et al. | 139/425 A |

FOREIGN PATENT DOCUMENTS

| | | | |
|---|---|---|---|
| 1115177 | 12/1981 | Canada | 139/425 A |
| 270625 | 8/1926 | United Kingdom | 139/408 |
| 398577 | 9/1933 | United Kingdom | 139/383 A |

*Primary Examiner*—James Kee Chi
*Attorney, Agent, or Firm*—John J. Torrente

[57] ABSTRACT

A clothing for use in a papermaking machine wherein the fabric includes two or more fabric layers, each layer comprised of woven structural longitudinal and transverse threads and each interconnected by additional transverse binder threads, and wherein at least the structural transverse threads of the lower fabric layer jointly interwoven with the transverse binder threads are arranged in pairs or as twin threads.

2 Claims, 3 Drawing Figures

MULTI-LAYER CLOTHING FOR PAPERMAKING MACHINES

BACKGROUND OF THE INVENTION

This invention relates to clothing for papermaking machines and, in particular, to clothing of the type including two or more fabric layers which comprise interwoven longitudinal and transverse structural threads and which are interconnected by additional transverse binder threads.

Clothing of the above type is particularly suited for use in the paper forming sections of papermaking machines and has been disclosed, for example, in U.S. Pat. Nos. 3,885,602 and 3,885,603 and Canadian Pat. No. 1,115,177. However, the use of transverse binder threads in this clothing gives rise to certain drawbacks. Thus, if the transverse binder threads are interwoven at high tension and, accordingly, firmly bond the two fabric layers together, deep dimples are formed at the interweaving points in the upper fabric layers, i.e. on the paper side. On the other hand, if the transverse binder threads are loosely interwoven, they are worn through, both on the running side and between the fabric layers, in a relatively short amount of time.

It is therefore an object of the present invention to provide clothing of the above-described type wherein the transverse binder threads do not leave any dimples on the paper side and do not wear through prematurely on the running side or between the fabric layers.

SUMMARY OF THE INVENTION

In accordance with the principles of the present invention, the above and other objectives are realized in clothing of the above-described type wherein at least the structural transverse threads of the lowermost fabric layer, which interweave jointly with the transverse binder threads, are arranged in pairs or as twin threads. As a result, each transverse binder thread in the lowermost fabric layer is embedded between corresponding twin structural transverse threads and a corresponding interwoven structural longitudinal thread. Preferably the diameter of the transverse binder threads is smaller than the diameter of the corresponding twin structural transverse threads, thereby further enhancing the embedded condition of the binder threads.

By embedding the transverse binder threads, the threads may now be interwoven at substantially lesser tension, either by a flatter course of the transverse binder threads, or by the selection of a more readily extensible material. Since the vertical component of force is responsible for the formation of dimples on the paper supporting side, the flatter course of the transverse binder threads results in better marking characteristics for the papermachine clothing.

It is also particularly advantageous if at least part of the structural transverse threads in the upper fabric layer are also arranged in pairs or as twin threads. In this case, at the interweaving points, one transverse thread of each arrangement of transverse twin threads interweaves with a corresponding longitudinal thread of the lower fabric layer as a transverse binder thread.

BRIEF DESCRIPTION OF THE DRAWINGS

The above and other features and aspects of the present invention will become more apparent upon reading the following detailed description in conjunction with the accompanying drawings in which.

DETAILED DESCRIPTION OF THE DRAWINGS

Figure 1:
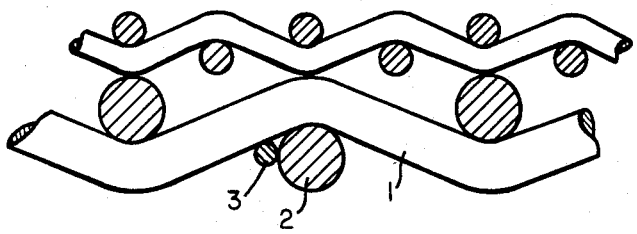
FIG. 1 PRIOR ART
FIG. 1 illustrates an arrangement of transverse binder threads and structural transverse threads in the lower fabric layer of a prior art clothing.

FIG. 1 shows the interweaving of a single transverse thread 2 with a longitudinal structural thread 1 in the lower fabric layer of a prior art clothing for a papermachine. At the same location at which the threads 1 and 2 are interwoven, a transverse binder thread 3 is also interwoven with the longitudinal structural thread 1.

As is conventional, the transverse binder thread 3 has a substantially smaller diameter, i.e., is thinner, than the structural thread 2. Also the central axes of the threads are at about the same level. Accordingly, it can be appreciated that after a relatively short period of time, the transverse binder thread 3 will begin to wear. Furthermore, owing to its smaller diameter, it will become worn through before the transverse structural thread 2.

While this wearing of the thread 3 can be slowed somewhat by interweaving the transverse binder thread more tightly, i.e., it can be shifted toward the paper side, this exerts excessive force in the downward direction on the longitudinal threads with which the binder thread interweaves in the upper fabric layer, i.e., toward the running side. As a result, dimples form in the upper fabric layer and impair the marking characteristics of the clothing.

Figure 2:
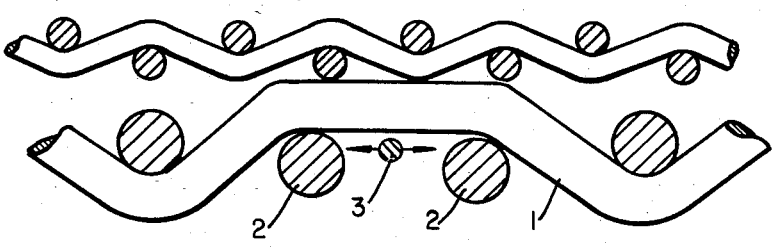
FIG. 2 PRIOR ART
FIG. 2 shows an arrangement of transverse binder threads and structural transverse threads in the lower fabric layer of a prior art clothing having a three-shed twill weave.

In some other types of prior art weaves, e.g., the three-shed twill weave and combined twill or satin (drape) weave, it is possible to arrange the transverse binder thread on the running side between two structural transverse threads of the lower fabric layer, as is illustrated in FIG. 2. In this case, the transverse binder thread is protected from abrasion, but it is not laterally stabilized. As a result, it moves transversely of its longitudinal direction. This causes shifting of the two fabric layers relative to each other and results in unnecessary wear of the adjacent faces of the two fabric layers.

Figure 3:
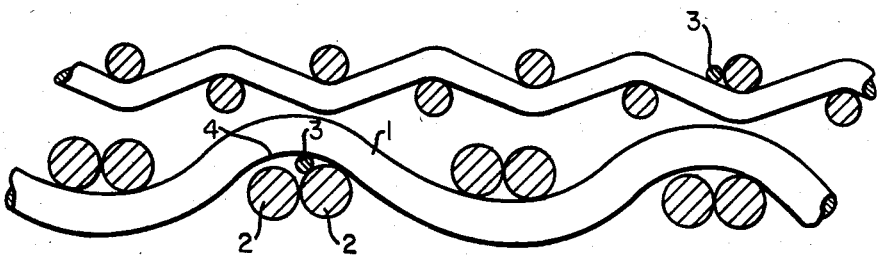
FIG. 3 shows an arrangement of transverse binder threads and twin structural transverse threads in the lower fabric layer of a clothing in accordance with the principles of the present invention.

In FIG. 3, the structural transverse threads and transverse binder threads of a lower fabric layer in accordance with the invention are shown. The structural transverse threads 2 are arranged as closely adjacent pairs, and the transverse binder thread 3 is situated therebetween. As a result, the thread 3 is urged against the highest point of the arc of the structural longitudinal thread 1 without any particular tension being exerted thereon. At this location, it is protected from abrasion.

More particularly, owing to the use of the pair of or twin transverse structural threads 2, the transverse binder thread 3 is enclosed between the two structural threads and the longitudinal thread 1 as clearly seen in FIG. 3. The two structural threads 2, urge the binder thread 3 into the longitudinal thread 1 so that all three transverse threads jointly participate in the deformation of the longitudinal thread. As a result, the binder thread 3 is embedded into the longitudinal thread at a relatively wide distance away from the plane of abrasion.

Thus, when using the lower fabric layer of FIG. 3 in a papermachine clothing, as the clothing is abraded, first the twin structural transverse threads 2 of the lower fabric layer wear through and, thereafter, the longitudinal structural threads 1 of the lower fabric layer wear through. As a result, the transverse binder threads 3 continue to hold together the remainder of the longitudinal threads of the lower fabric layer until the very end, i.e., even when the running side of the papermachine fabric is already worn through. This, in turn, results in an increase in the operating period of the papermachine clothing since the material of the longitudinal and transverse structural threads in the lower fabric layer will be completely worn prior to any separation of the two fabric layers.

Furthermore, owing to the low tensile stress present in the transverse binder thread 3, and on account of the latter's flatter course, the transverse binder thread 3 exerts lesser downwardly directed force on the longitudinal structural threads with which it is interwoven in the upper fabric layer. Thus, with this configuration no or only slight dimples are treated on the paper side.

It should be noted that clothing made in accordance with the invention will usually comprise only two layers, an upper fabric layer and a lower fabric layer. The lower fabric layer forming the running side will be configured in accordance with FIG. 3, and in general will have a warp and pick number which is only half that of the upper fabric layer. The upper fabric layer, furthermore, will usually be woven more finely than the lower fabric layer.

Also, in general, the transverse and longitudinal threads will be formed of plastic wires made of material conventionally used for papermachine clothings, e.g. polyester and polyalmide. Furthermore, the weave employed can be flat or endless. In the flat type, the transverse threads form the weft threads or wires while in the endless type they form the warp threads or wires.

The principles of the present invention are also applicable to longitudinal binder threads. In such case, the structural longitudinal threads jointly interwoven with the longitudinal binder threads are arranged as twin threads.

The use of structural transverse threads in pairs in accordance with the invention implies that each pair of threads is employed in lieu of a conventional single transverse thread. The total cross section of the twin structural transverse threads of the invention thus corresponds appoximatley to the cross sectional area of a single structural transverse thread of the prior art in an otherwise comparable papermachine fabric.

It should also be noted that the upper fabric layer of the clothing in accordance with the invention can be conventional and have threads extending in the same way as in prior art clothing. Furthermore, it is advantageous if at least part of the structural transverse threads in the upper fabric layer are also arranged in pairs or as twin threads. In such case, at the interweaving points, one transverse thread of each arrangement of the transverse twin threads interweaves with a corresponding longitudinal thread of the lower fabric layer as a transverse binder thread.

EXAMPLE

The papermachine fabric comprises two fabric layers each forming a complete fabric in itself and each being interconnected by way of additional binder weft wires. Both fabric layers are woven flat so that the warp wires form the longitudinal threads and the weft wires form the transverse threads.

The upper fabric layer has a plain weave with 28 warp wires per centimeter. The warp wires have a diameter of 0.17 mm and are comprised of Trevira® 940 polyester monofilament. The pick number of the upper fabric layer is 24 weft wires per centimeter. The weft wires have a diameter of 0.20 mm and are comprised of Trevira® 900 polyester monofilament.

The lower fabric layer is likewise woven in plain weave and has 14 warp wires per centimeter. The warp wires have a diameter of 0.30 mm and are made of Trevira® 940 polyester monofilament. All the weft wires of the lower fabric layer are arranged as twin wires in accordance with FIG. 3, the weft density being 12 wire pairs per centimeter, i.e., 24 individual wires per centimeter. The diameter of the weft wires is 0.25 mm each. The material of the two individual wires of each pair of weft wires is different, one weft wire comprising Trevira® 900 polyester monofilament, while the other comprises a nylon-6, 6 monofilament.

The binder weft wires interconnecting the two fabric layers have a diameter of 0.17 mm and are made of Trevira® 900 polyester monofilament. The binder weft wires are interwoven with the upper fabric layer after each fourth weft wire. The points of interweaving are diagonally offset in the running direction so that the binder weft interweaves with the same warp wire of the upper fabric layer after 12 weft wires of the upper fabric layer.

In all cases, it is understood that the above-identified arrangements are merely illustrative of the many possible specific embodiments which represent applications of the present invention. Numerous and varied other arrangements can readily be devised in accordance with the principles of the present invention without departing from the spirit and scope of the invention.

What is claimed is:

1. Paper forming fabric comprising: at least two fabric layers of interwoven structural longitudinal and transverse threads and additional transverse binder threads interconnecting said fabric layers; said fabric layers comprising an upper fabric layer and a lowermost fabric layer; the upper fabric layer being woven more finely than the lowermost fabric layer; the transverse binder threads (3) being thinner than the structural transverse threads (2) of the lowermost fabric layer; at least the structural transverse threads (2) of the lowermost fabric layer interwoven jointly with the transverse binder threads (3) being arranged as twin threads and enclosing the transverse threads (3) in the lowermost fabric layer between the corresponding twin structrual transverse threads (2) and the structural longitudinal thread (1) interwoven at the respective location; the binder threads (3) thereby being urged against the highest point (4) of the arc of the structural longitudinal threads (1) of the lowermost fabric layer without any particular tension being exerted thereon.

2. A clothing according to claim 1 wherein: at least part of the structural transverse threads in the upper fabric layer are arranged as twin threads, and at the interweaving points one structural transverse thread of each arrangement of twin structural transverse threads in the upper fabric layer is interwoven as a transverse binder thread with a longitudinal thread of the lowermost fabric layer.

* * * * *